US010269237B2

(12) United States Patent
Endo et al.

(10) Patent No.: US 10,269,237 B2
(45) Date of Patent: Apr. 23, 2019

(54) CONTROL SYSTEM, CONTROL METHOD, ELECTRICAL APPARATUS, CONTROL DEVICE, AND PROGRAM

(71) Applicant: Mitsubishi Electric Corporation, Tokyo (JP)

(72) Inventors: Satoshi Endo, Tokyo (JP); Hirotoshi Yano, Tokyo (JP); Masaaki Yabe, Tokyo (JP); Satoshi Minezawa, Tokyo (JP); Ichiro Maruyama, Tokyo (JP); Masayuki Komatsu, Tokyo (JP); Yuki Ogawa, Tokyo (JP); Kaori Sato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 458 days.

(21) Appl. No.: 14/908,147

(22) PCT Filed: Aug. 8, 2014

(86) PCT No.: PCT/JP2014/071124

§ 371 (c)(1),
(2) Date: Jan. 28, 2016

(87) PCT Pub. No.: WO2015/020221

PCT Pub. Date: Feb. 12, 2015

(65) Prior Publication Data

US 2016/0189538 A1 Jun. 30, 2016

(30) Foreign Application Priority Data

Aug. 8, 2013 (JP) ..... 2013-165582

(51) Int. Cl.
*G08C 17/02* (2006.01)
*F24F 11/56* (2018.01)

(52) U.S. Cl.
CPC ..... *G08C 17/02* (2013.01); *F24F 11/56* (2018.01); *G08C 2201/40* (2013.01);
(Continued)

(58) Field of Classification Search
CPC ..... G08C 17/02; G08C 2201/60; G08C 2201/93; G08C 2201/40; G08C 2201/91; F24F 11/56
See application file for complete search history.

(56) References Cited

U.S. PATENT DOCUMENTS 6,574,798 B1 * 6/2003 Bradley ..... H04N 7/165 340/4.37
2006/0121863 A1 * 6/2006 Yoshida ..... G08C 17/02 455/151.1

(Continued)

FOREIGN PATENT DOCUMENTS

JP S59-091792 A 5/1984
JP H01-264499 A 10/1989

(Continued)

OTHER PUBLICATIONS

Office Action dated Sep. 27, 2016 issued in corresponding JP patent application No. 2014-266728 (and partial English translation).

(Continued)

*Primary Examiner* — Thomas D Alunkal
(74) *Attorney, Agent, or Firm* — Posz Law Group, PLC

(57) ABSTRACT

Upon receiving a command signal transmitted from a remote controller (100), based on contents of the received command signal, a setter of an electrical apparatus sets a time interval for prohibition of operation from an operation terminal. During the time interval set by the setter, an operation controller of the electrical apparatus does not control based (Continued)

on the received command signal, even if a command signal transmitted from the operation terminal is received via a HEMS controller.

10 Claims, 11 Drawing Sheets

(52) U.S. Cl.
CPC ..... *G08C 2201/60* (2013.01); *G08C 2201/91* (2013.01); *G08C 2201/93* (2013.01)

(56) References Cited

U.S. PATENT DOCUMENTS

| | | | | |
|---|---|---|---|---|
| 2012/0287220 | A1* | 11/2012 | Ravi | H04N 7/148 348/14.02 |
| 2013/0088419 | A1* | 4/2013 | Kim | G09G 5/00 345/156 |
| 2015/0131008 | A1* | 5/2015 | Robinson | G08C 17/02 348/734 |
| 2015/0208013 | A1* | 7/2015 | Friedrich | H04N 21/42215 348/734 |
| 2015/0369508 | A1* | 12/2015 | Rosen | F24D 19/1084 165/237 |

FOREIGN PATENT DOCUMENTS

| | | | |
|---|---|---|---|
| JP | 2003-120984 | A | 4/2003 |
| JP | 2003-198745 | A | 7/2003 |
| JP | 2004-056466 | A | 2/2004 |
| JP | 2005-241208 | A | 9/2005 |
| JP | 2006-254161 | A | 9/2006 |
| JP | 2007-024420 | A | 2/2007 |
| JP | 2008-042262 | A | 2/2008 |
| JP | 2008-124960 | A | 5/2008 |
| JP | 2013-009033 | A | 1/2013 |

OTHER PUBLICATIONS

Extended European Search Report dated Feb. 16, 2017 in the corresponding EP application No. 14834396.5.
Korean Office Action dated Jan. 10, 2017 in the corresponding KO application No. 10-2016-7005608. (Partial translation attached).
International Search Report of the International Searching Authority dated Nov. 4, 2014 for the corresponding international application No. PCT/JP2014/071124 (and English translation).
Office Action dated Oct. 28, 2014 issued in corresponding JP patent application No. 2013-165582 (and partial English translation).

* cited by examiner

FIG. 3

| NO. | CONTENTS OF COMMAND SIGNAL | SETTING CONDITION | TIME |
|---|---|---|---|
| 1 | START AIR CONDITIONING | ROOM INTERNAL TEMPERATURE GREATER THAN 28°C | 60 MINUTES |
| 2 | START AIR CONDITIONING | ROOM INTERNAL TEMPERATURE LESS THAN OR EQUAL TO 28°C | 30 MINUTES |
| 3 | CHANGE AIR CONDITIONING TEMPARATURE | RANGE OF CHANGE LESS THAN 2°C | 15 MINUTES |
| ⋮ | ⋮ | ⋮ | ⋮ |

FIG. 11

| CONTENTS OF COMMAND SIGNAL | EXCEPTION CONDITION |
| --- | --- |
| CHANGE AIR CONDITIONING TEMPERATURE | ROOM INTERNAL TEMPERATURE GREATER THAN 28°C, AND FIRST OPERATION BY THE OPERATION TERMINAL DURING THE REMOTE OPERATION PROHIBITION TIME INTERVAL |
| STOP AIR CONDITIONING | ROOM INTERNAL TEMPERATURE LESS THAN OR EQUAL TO 28°C, AND FIRST OPERATION BY THE OPERATION TERMINAL DURING THE REMOTE OPERATION PROHIBITION TIME INTERVAL |
| ⋮ | ⋮ |

CONTROL SYSTEM, CONTROL METHOD, ELECTRICAL APPARATUS, CONTROL DEVICE, AND PROGRAM

CROSS REFERENCE TO RELATED APPLICATIONS

This application is a U.S. national stage application of International Patent Application No. PCT/JP2014/071124 filed on Aug. 8, 2014, which claims priority to Japanese Patent Application No. 2013-165582 filed on Aug. 8, 2013, the disclosures of which are incorporated herein by reference.

TECHNICAL FIELD

The present disclosure relates to a control system, control method, electrical apparatus, control device and program.

BACKGROUND ART

Various types of proposals are made relating to technology for remote control of an electrical apparatus such as an air conditioner. For example, technology is known that prioritizes, from standpoints such as safety, manual operation using a dedicated remote control or the like, over normal operation by remote control (such as in Patent Literature 1).

According to the remote control system described in Patent Literature 1, when an operation is performed by a manual switch to control a load (electrical apparatus), remote control is not accepted during a fixed time interval.

This configuration, for example, can prevent a situation in which remote control is performed immediately after operation by the manual switch during an emergency or the like.

CITATION LIST

Patent Literature

Patent Literature 1: Unexamined Japanese Patent Application Kokai Publication No. H1-264499

SUMMARY OF INVENTION

Technical Problem

When a user operation occurs by manual switching in the aforementioned remote control system, remote control is forbidden across-the-board for a fixed time interval. Thus the user can feel a sense of inconvenience, and a more useful proposal is needed.

In view of the aforementioned circumstances, an objective of the present disclosure is to provide a control system and the like that is capable of remote control, while maintaining safety and without causing inconvenience.

Solution to Problem

In order to achieve the aforementioned objective, a control system according to the present disclosure includes:

an electrical apparatus configured to receive from a remote controller a command signal indicating a control command for the electrical apparatus, a transmission area of the command signal being predetermined; and a control device configured to:

receive the command signal indicating the control command for the electrical apparatus from an operation terminal capable of transmitting, in addition to from the transmission area, from outside the transmission area; and transmit to the electrical apparatus the command signal indicating the control command for the electrical apparatus, wherein the electrical apparatus comprises:

an operation controller configured to control a main operator according to the command signal transmitted from the remote controller or according to the command signal transmitted from the operation terminal; and a setter configured to set a time interval for prohibiting, based on contents of the command signal transmitted from the remote controller, operation from the operation terminal, and the operation controller is further configured to, during the time interval, not control based on the received command signal, even when the command signal transmitted from the operation terminal is received via the control device.

Advantageous Effects of Invention

According to the present disclosure, the time interval of prohibiting remote operation is set according to contents of the command signal transmitted from the remote controller. Thus remote control can be performed while maintaining safety and without inconveniencing the user.

BRIEF DESCRIPTION OF DRAWINGS

FIG. 3 is a figure showing a prohibition table according to the first embodiment;

FIG. 11 is a figure showing an exception table.

DESCRIPTION OF EMBODIMENTS

First Embodiment

Figure 1:
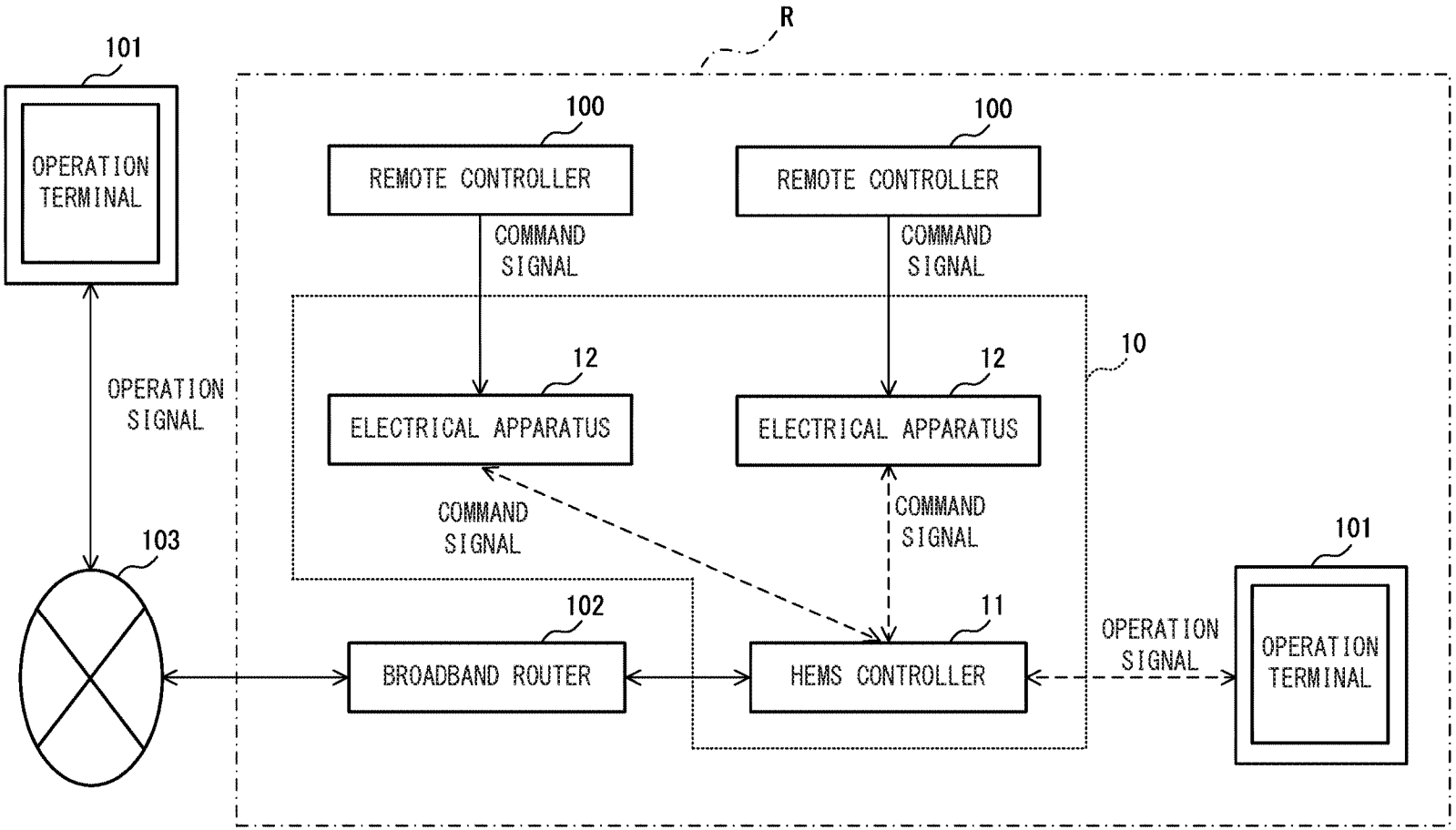
FIG. 1 is a drawing showing a control system according to a first embodiment.

A control system 10 according to a first embodiment of the present disclosure is explained below in reference to FIGS. 1 to 5. A control system 10 shown in FIG. 1 includes a single home energy management system (HEMS) controller 11 for transmitting to an electrical apparatus 12 a command signal that is included in an operation signal transmitted from an operation terminal 101. Moreover, the control system 10 includes multiple electrical apparatuses 12 that run according to respective command signals transmitted from the HEMS controller 11 or according to command signals transmitted from a remote controller 100.

When the operation signal, that is, a signal associating a command signal commanding control of the electrical apparatus 12 with equipment information capable of specifying the electrical apparatus 12 that is the subject of control, transmitted from the operation terminal 101 is received, the HEMS controller 11 transmits the command signal included in the operation signal to the electrical apparatus 12 specified by the equipment information included in the operation signal. The electrical apparatus 12 operates according to the command signal. Furthermore, the HEMS controller 11 corresponds to the "control device" mentioned in the Claims.

The electrical apparatuses 12 are apparatuses such as air conditioners, televisions, and the like. The electrical apparatus 12, as explained above, operates according to the command signal transmitted from the HEMS controller 11. Moreover, the electrical apparatus 12 operates according to a command signal, that is, a signal commanding control of the electrical apparatus 12, transmitted from a remote controller 100.

The remote controller 100, for example, is a remote controller dedicated for use with a respective electrical apparatus 12. The transmission area for the command signal of the remote controller 100 is predetermined. Thus the operator of the remote controller 100 operates the remote controller 100 at a position from which the electrical apparatus 12 can be seen, for example, such as in the vicinity of the electrical apparatus 12.

The operation terminal 101, for example, is a portable device such as a tablet-type personal computer, smart phone and the like. The operation terminal 101 can communicate with the HEMS controller 11, for example, by wireless fidelity (Wi-Fi) communication. Moreover, the operation terminal 101 can communicate with the HEMS controller 11 through the internet 103 and a broadband router 102. Thus the operation terminal 101 can transmit the operation signal to the HEMS controller 11, in addition to from within the transmission area of the remote controller 100, also from outside the transmission area of the remote controller 100. A user interface is installed in the operation terminal 101 for operation of the electrical apparatus 12 via the HEMS controller 11.

The above-described control system 10 and the broadband router 102 are generally arranged within a room interior R, including the periphery of a building. As described above, the remote controller 100 is used in the vicinity of the corresponding electrical apparatus 12. In addition to use in the room interior R, the operation terminal 101 can be used at a location far from the room interior R.

Figure 2:
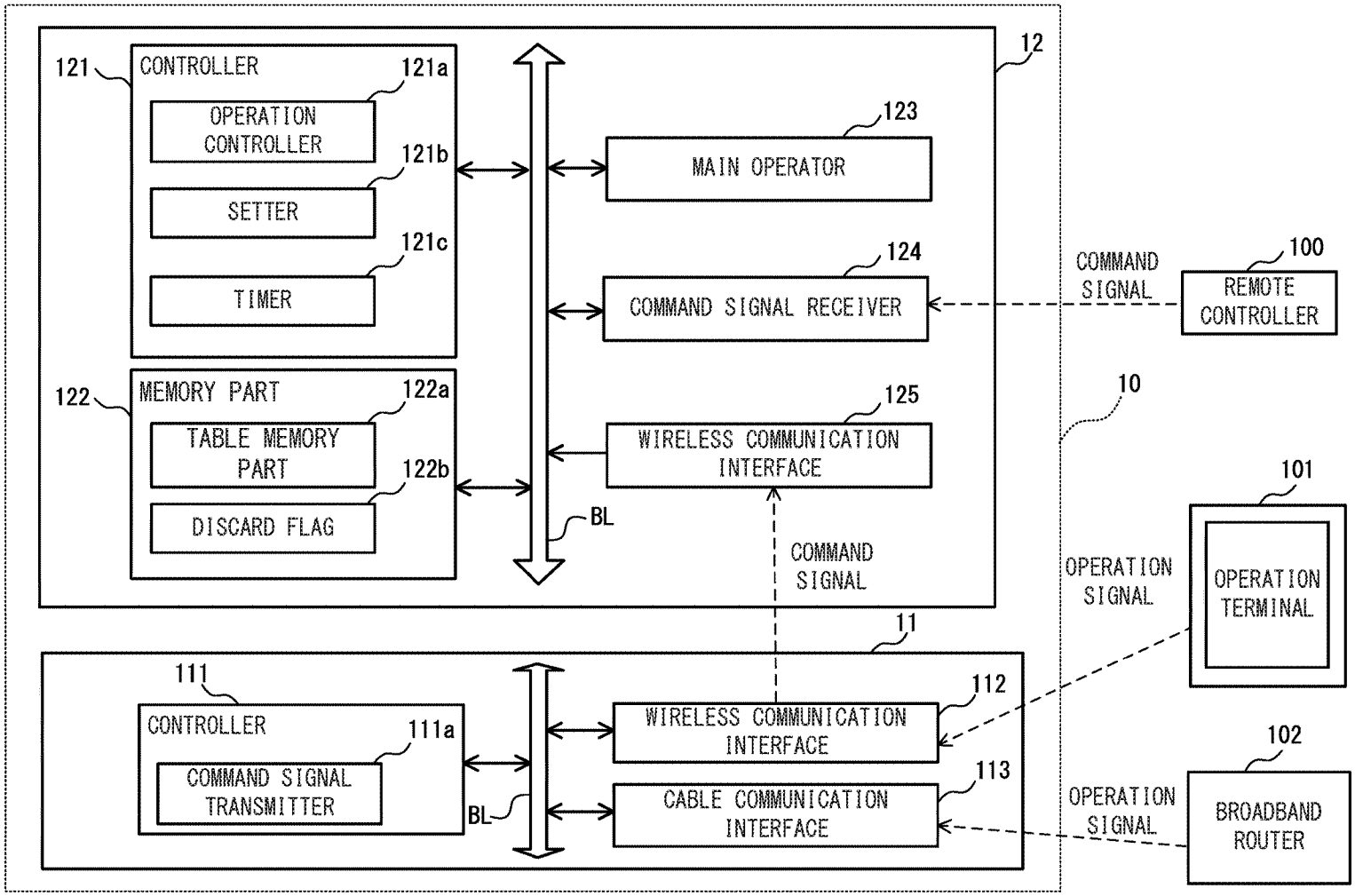
FIG. 2 is a block diagram of the control system according to the first embodiment.

The HEMS controller 11, as indicated in FIG. 2, is equipped with a controller 111 for overall control of the HEMS controller 11, a wireless communication interface 112 to make possible wireless communication such as Wi-Fi communication, and a cable communication interface 113 to make possible cable communication. The controller 111, the wireless communication interface 112 and the cable communication interface 113 are interconnected by a bus line BL.

In particular, the controller 111 is equipped with a central processing unit (CPU), read only memory (ROM), and random access memory (RAM).

By the CPU executing a program stored in ROM (for example, a program for enabling execution of the below-described operations indicated in FIG. 4), the operation signal transmitted from the operation terminal 101 is received, and the command signal transmitter 111*a* transmits to the wireless communication interface 112 the command signal included in the received operation signal.

The wireless communication interface 112 performs wireless communication, such as Wi-Fi communication, with a below-described wireless communication interface 125 arranged in the electrical apparatus 12, and transmits to the wireless communication interface 125 the command signal transmitted from the operation terminal 101.

The cable communication interface 113 performs cable-based communication with the broadband router 102 and receives the operation signal from the operation terminal 101 connected to the internet 103.

The electrical apparatus 12 is equipped with a controller 121 for overall control of the electrical apparatus 12, a memory part 122 for storage of information accessed by the controller 121, a main operator 123 as a constituent part for realizing fundamental functions of the electrical apparatus 12 such as a heat exchange function and the like, a command signal receiver 124 for receiving the command signal transmitted from the remote controller 100, and the wireless communication interface 125 for enabling wireless communication. The various parts 121 through 125 are mutually interconnected by a bus line BL. The command signal receiver 124 corresponds to the "first receiver" mentioned in the Claims. Moreover, the wireless communication interface 125 corresponds to the "second receiver" mentioned in the Claims.

According to the present embodiment, when the command signal is received by the command signal receiver 124, even if a command signal is received by the wireless communication interface 125 thereafter (that is, even if the command signal transmitted from the operation terminal 101 is received), during a remote operation prohibition time interval, the electrical apparatus 12 discards the command signal received by the wireless communication interface 125. That is to say, when user operation is performed using the remote controller 100, even if an operation command is thereafter given to the electrical apparatus 12 by user operation, such as by remote operation, of the operation terminal 101, the electrical apparatus 12 does not execute control corresponding to such an operation command during the remote operation prohibition time interval. Thus control by operation command of the user who understands conditions of the room interior R can be prevented from causing change during the remote operation prohibition time interval.

As explained below in detail, according to the present embodiment, the electrical apparatus 12 sets the aforementioned remote operation prohibition time interval based on contents of the command signal and the like received using the command signal receiver 124. By this means, user convenience is improved in comparison to a system that, after a user operation is performed using the remote controller 100, prohibits remote operation across-the-board for a fixed time interval.

The controller 121 is equipped with a CPU, ROM and RAM.

By execution of a program stored in ROM, that is, by execution of the program to perform the below-described operations indicated in FIG. 4 and processing shown in FIG. 5, the CPU of the controller 121 is enabled to function as the operation controller 121*a* for control of the main operator 123, and enabled to function as the setter 121*b* for setting the time interval, that is, the remote operation prohibition time interval, for discarding of the command signal received using the wireless communication interface 125. Moreover, the CPU of the controller 121 is equipped with a timer 121*c* for counting down the remaining time until completion of the remote operation prohibition time interval.

Upon reception of the command signal transmitted from the remote controller 100 via the command signal receiver 124, the operation controller 121*a* controls the main operator 123 according to the contents of the command signal. Moreover, upon reception of the command signal transmitted from the HEMS controller 11 through the wireless communication interface 125, the operation controller 121*a* controls the main operator 123 according to the contents of the command signal.

Upon receiving the command signal via the command signal receiver 124, the setter 121*b* searches a prohibition table stored in the memory part 122 for a record that matches the contents of the command signal. The prohibition table is a table of data recording multiple records associating contents of the command signal, setting conditions, and times. Thereafter, if a setting condition included in the searched record is satisfied, such as the room interior temperature being at least 28° C., then the setter 121*b* determines that the time included in the record is the remote operation prohibition time interval. Thereafter, the setter 121*b* sets the timer 121*c* using a count value corresponding to the determined remote operation prohibition time interval, and causes the timer 121*c* to start the countdown. Also, the setter 121*b* turns a below-described discard flag 122*b* ON. If the discard flag 122*b* is ON, even when the command signal is received using the wireless communication interface 125, the operation controller 121*a* discards the received command signal, that is, does not perform control of the main operator 123 based on remote operation.

When the countdown of the timer 121*c* is completed, the setter 121*b* turns the discard flag 122*b* OFF. If the discard flag 122*b* is OFF, when the command signal is received using the wireless communication interface 125, the operation controller 121*a* controls the main operator 123 according to the contents of the command signal.

The memory part 122, for example, includes flash memory. The memory part 122 stores a table memory part 122*a* for storing the aforementioned prohibition table and the discard flag 122*b*, which is turned ON at the start of countdown of the timer 121*c* and turned OFF at the completion of countdown of the timer 121*c*.

FIG. 3 shows one example of the prohibition table stored in the table memory part 122*b*. FIG. 3 shows an example of the prohibition table in which the electrical apparatus 12 is an air conditioner.

As mentioned above, the setter 121*b* sets the remote operation prohibition time interval based on the prohibition table. For example, when the command signal indicating a start of cooling is received via the command signal receiver 124, within the prohibition table stored in the memory part 122, the setter 121*b* searches for a record that matches the contents of the received command signal. In the case of the prohibition table shown in FIG. 3, the no. 1 and no. 2 records are retrieved.

Thereafter, because the setting condition included in the searched record is a condition relating to a room interior temperature, the setter 121*b* uses the room internal temperature measured using a temperature sensor of the electrical apparatus 12 that is the subject of control, and determines whether or not the setting condition associated with the searched content is satisfied. The room internal temperature is included in condition data acquired periodically from the electrical apparatus 12. In the present embodiment, the setter 121*b* determines whether or not the room internal temperature exceeds 28° C. If the room internal temperature exceeds 28° C., the setter 121*b* sets the remote operation prohibition time interval to 60 minutes. On the other hand, if the room internal temperature is less than or equal to 28° C., the setter 121*b* sets the remote operation time interval to 30 minutes.

In addition, for example, if the command signal receiver 124 receives a command signal indicating change of air conditioning temperature, and if the range of the temperature change indicated by the command signal is within 2° C., then the setter 121*b* sets the remote operation prohibition time interval to 15 minutes.

The setter 121*b* sets the timer 121*c* to the count value corresponding to the set remote operation prohibition time interval and causes the timer 121*c* to start the countdown.

The main operator 123 is a constituent part for enabling fundamental functions of the electrical apparatus 12, such as a heat exchanger and inverter circuit and the like if the electrical apparatus 12 is an air conditioner, for example, and such as a channel switching circuit if the electrical apparatus 12 is a television.

Figure 4:
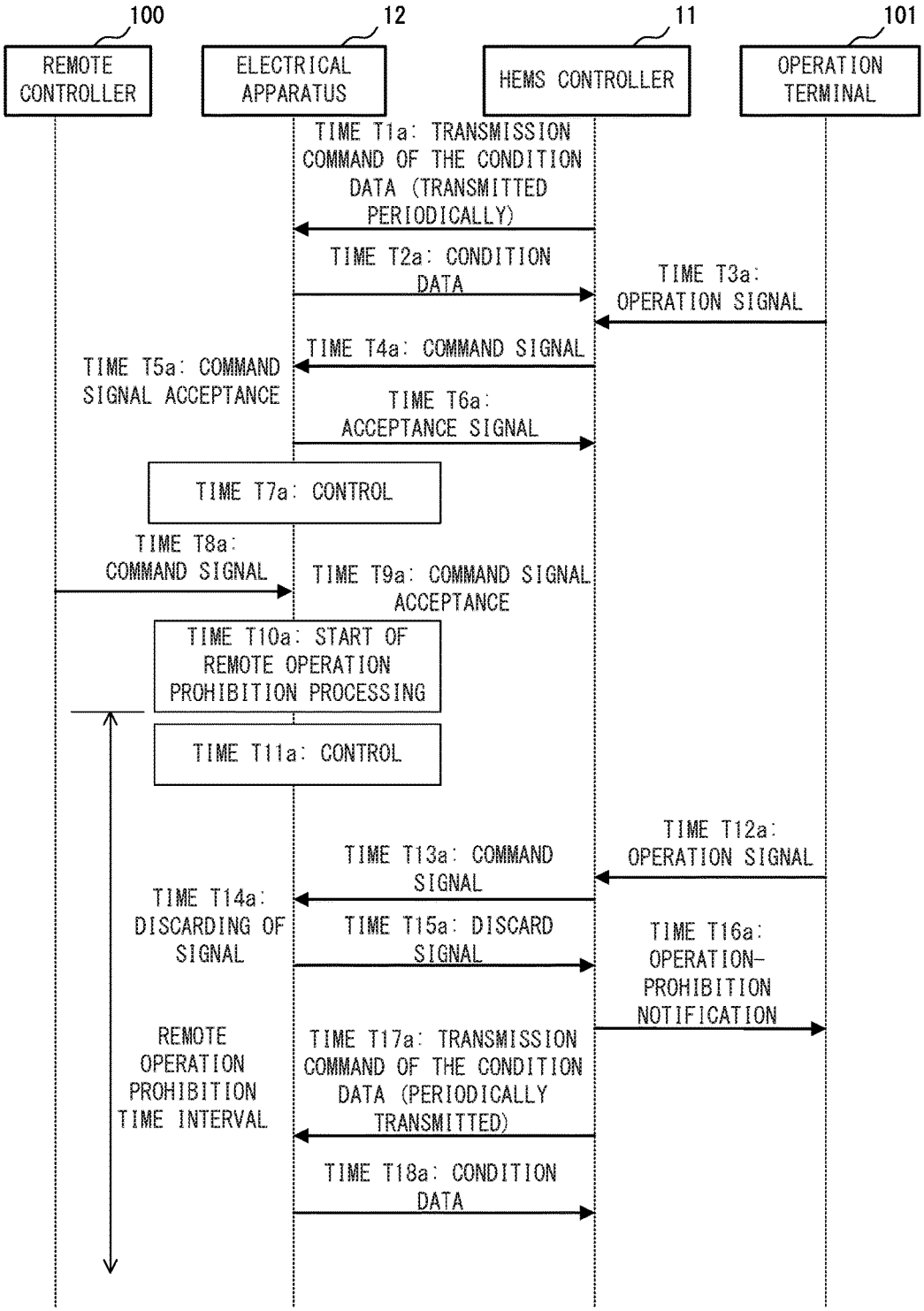
FIG. 4 is a diagram showing operation of the control system according to the first embodiment.

Referring to FIG. 4, operation is explained below in the case in which power is turned ON to each of the aforementioned HEMS controller 11, the electrical apparatus 12, the remote controller 100, and the operation terminal 101.

Firstly, the HEMS controller 11 transmits to the electrical apparatus 12 a transmission command requesting the transmission of condition data indicating condition of the electrical apparatus 12 (time T1*a*). In response to this transmission command, the electrical apparatus 12 transmits the condition data to the HEMS controller 11 (time T2*a*).

The condition data is data, for example, indicating air conditioning setting temperature, operation condition, room internal temperature, contents of the received command signal and transmission source of the command signal. In the case of operation of the electrical apparatus 12 using the operation terminal 101, the user generally displays on the operation terminal 101 the latest condition of the electrical apparatus 12. In order to achieve this display, if there is a previous request from the operation terminal 101, the HEMS controller 11 transmits to the operation terminal 101 the condition data acquired from the electrical apparatus 12. For such transmission, the HEMS controller 11 periodically acquires the condition data from the electrical apparatus 12.

The condition data can change with passage of time. Thus the HEMS controller 11 transmits to the electrical apparatus 12 the transmission command for the condition data, for example, every one minute.

When a user operation is performed using the operation terminal 101, the operation signal is transmitted from the operation terminal 101 (time T3*a*), and then when this operation signal is received by the HEMS controller 11, the HEMS controller 11 (command signal transmitter 111*a*) transmits to the electrical apparatus 12 designated by the operation signal the command signal included in the received operation signal (time T4*a*).

Upon receiving the command signal (time T5*a*), the electrical apparatus 12 (operation controller 121*a*) transmits to the HEMS controller 11 an acceptance signal indicating that the command signal is received (time T6*a*). Then according to the content of the received command signal, the electrical apparatus 12 (operation controller 121*a*) controls the main operator 123 (time T7*a*).

Thereafter, a user operation is performed using the remote controller 100, the command signal is then transmitted from the remote controller 100 (time T8*a*), and this command signal is received by the electrical apparatus 12 (time T9*a*).

Figure 5:
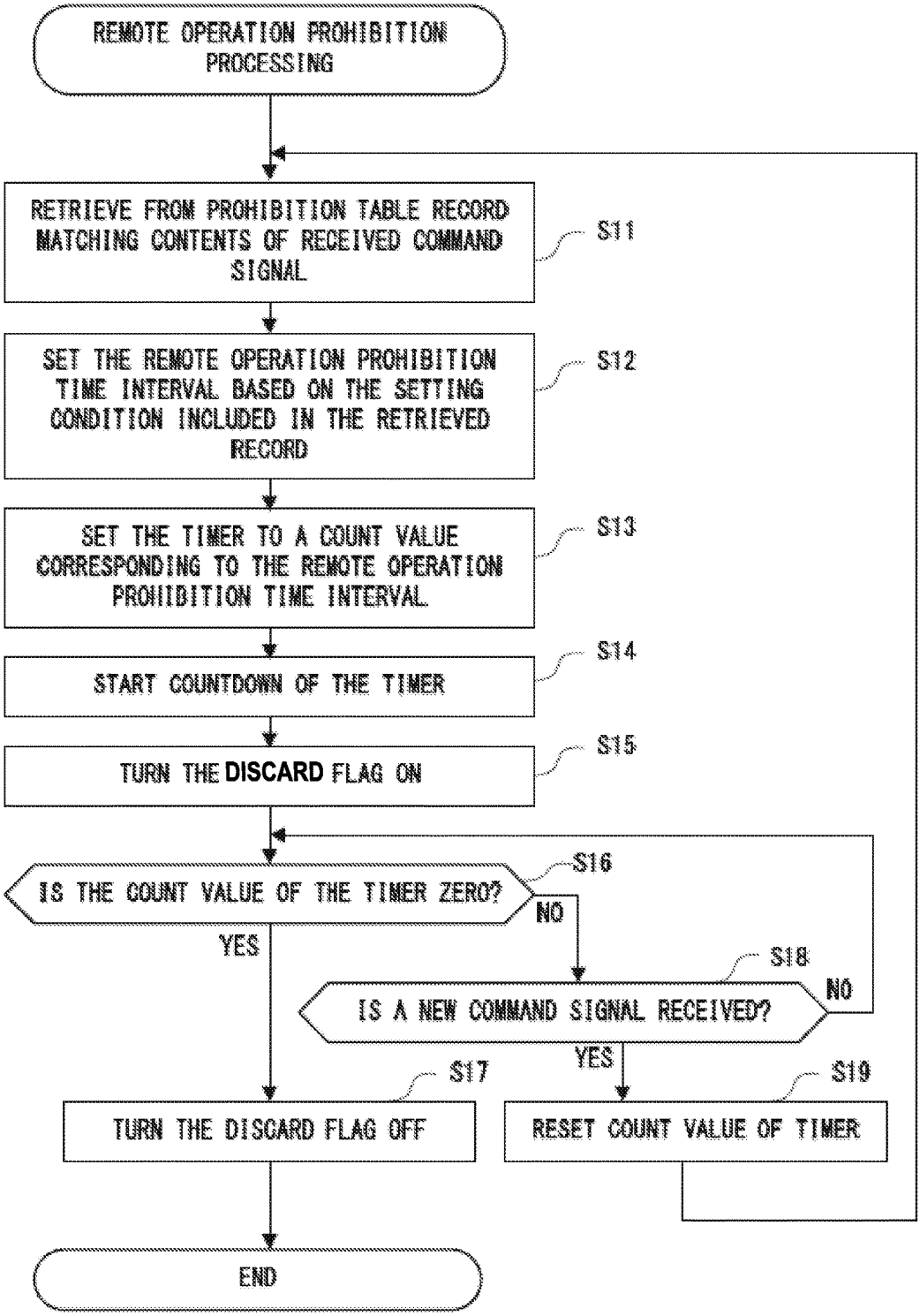
FIG. 5 is a flow chart showing remote operation prohibition processing according to the first embodiment.

Then, the electrical apparatus 12 starts the remote operation prohibition processing as shown in FIG. 5 (time T10*a*) to prohibit remote operation.

During the remote operation prohibition processing, the electrical apparatus 12 (setter 121*b*) retrieves from the prohibition table a record that matches the content of the received command signal (step S11). For example, if the prohibition table is the table shown in FIG. 3, when the command signal is received indicating the start of air conditioning, records no. 1 and no. 2 are retrieved.

Thereafter, the electrical apparatus 12 (setter 121*b*) sets the remote operation prohibition time interval based on the setting condition included in the retrieved records (step S12). If the room internal temperature measured by the temperature sensor included in the electrical apparatus 12 that is the subject of control exceeds 28° C., for example, the electrical apparatus 12 (setter 121*b*) sets the remote operation prohibition time interval to 60 minutes. On the other hand, if the room internal temperature is less than or equal to 28° C., for example, the electrical apparatus 12 (setter 121*b*) sets the remote operation prohibition time interval to 30 minutes.

Thereafter, the electrical apparatus 12 (setter 121*b*) sets the timer 121*c* to the count value corresponding to the set remote operation prohibition time interval (step S13) and causes the timer 121*c* (step S14) to start the countdown. Moreover, the electrical apparatus 12 (setter 121*b*) turns the discard flag 122*b* ON (step S15). If the discard flag 122*b* is ON, even when a command signal is received using the wireless communication interface 125, the electrical apparatus 12 (operation controller 121*a*) discards the received command signal, that is, remote operation is prohibited.

Thereafter, the electrical apparatus 12 (setter 121*b*) determines whether the count value of the timer 121*c* is zero, that is, determines whether the remote operation prohibition time interval has passed (step S16). When the remote operation prohibition time interval is passed (step S16 result=YES), the electrical apparatus 12 (setter 121*b*) turns the discard flag 122*b* OFF (step S17), and this processing ends.

On the other hand, if the remote operation prohibition time interval is not passed (step S16 result=NO), the electrical apparatus 12 (setter 121*b*) determines whether a command signal is newly received from the remote controller 100 (step S18).

If a new user operation is performed using the remote controller 100, and if the new command signal is transmitted from the remote controller 100 and then this command signal is received (step S18 result=YES), the electrical apparatus 12 (setter 121*b*) resets the count value of the timer 121*c* (step S19), and processing returns to step S11. In this manner, when the command signal is newly transmitted from the remote controller 100, the electrical apparatus 12 (setter 121*b*) resets the timing by the countdown of the timer 121*c*.

On the other hand, if a new command signal is not received from the remote controller 100 (result of step S18=NO), then processing returns to step S16 for the electrical apparatus 12 (setter 121*b*).

When a new command signal is received from the remote controller 100, as indicated at time T11*a* in FIG. 4, the electrical apparatus 12 (operation controller 121*a*) controls the main operator 123 according to the content of the received command signal.

When the user operation is performed using the operation terminal 101, when the operation signal then is transmitted from the operation terminal 101 (time T12*a*), and then when this operation signal is received by the HEMS controller 11, the HEMS controller 11 (command signal transmitter 111*a*) transmits to the electrical apparatus 12 the command signal included in the received operation signal (time T13*a*).

Upon reception of the command signal, the electrical apparatus 12 (operation controller 121*a*) determines whether the discard flag 122*b* is ON or OFF. During the remote operation prohibition time interval, the discard flag 122*b* is ON. Thus the electrical apparatus 12 (operation controller 121*a*) discards the received command signal (time T14*a*). That is to say, in this case, control is not performed based on remote operation. The electrical apparatus 12 (operation controller 121*a*) transmits to the HEMS controller 11 a discard signal that indicates that the command signal is discarded, that is, that indicates that remote control is prohibited (time T15*a*).

When the discard signal is received, the HEMS controller 11 transmits to the operation terminal 101 an operation-prohibition notification indicating that the operation signal is not previously received (time T16*a*).

The transmission command (transmission command of the condition data) transmitted periodically from the HEMS controller 11 is not an instruction for the electrical apparatus 12 to control the main operator 123. Thus even during the remote operation prohibition time interval, when the transmission command is received (time T17*a*), the electrical apparatus 12 transmits to the HEMS controller 11 the condition data (time T18*a*).

When the remote operation prohibition time interval is completed, in the above-described manner, the electrical apparatus 12 (operation controller 121*a*) turns the discard flag 122*b* OFF. By this means, upon receiving the command signal using the wireless communication interface 125, the electrical apparatus 12 (operation controller 121*a*) controls the main operator 123 according to the content of the command signal.

As described above, according to the control system 10 of the present embodiment, when the command signal is received using the command signal receiver 124, the electrical apparatus 12 sets the remote operation prohibition time interval, and during the time interval, all command signals received via the wireless communication interface 125 are discarded. That is to say, during the remote operation prohibition time interval, even when user operation of the operation terminal 101 provides a command for operation of the electrical apparatus 12, the electrical apparatus 12 does not execute control corresponding to the operation command. Thus remote-control-based execution of control that is unanticipated immediately beforehand by the user operating the remote controller 100 can be prevented, and as a result, safety and user comfort can be secured.

Moreover, according to the control system 10 of the present embodiment, based on content of the command signal and the like transmitted by the remote controller 100, the electrical apparatus 12 sets the remote operation prohibition time interval. By this means, the remote operation prohibition time interval can be set appropriately based on the operation content, condition of the room interior R and the like. Thus safe remote control can be achieved without loss of convenience for the user.

Second Embodiment

Figure 6:
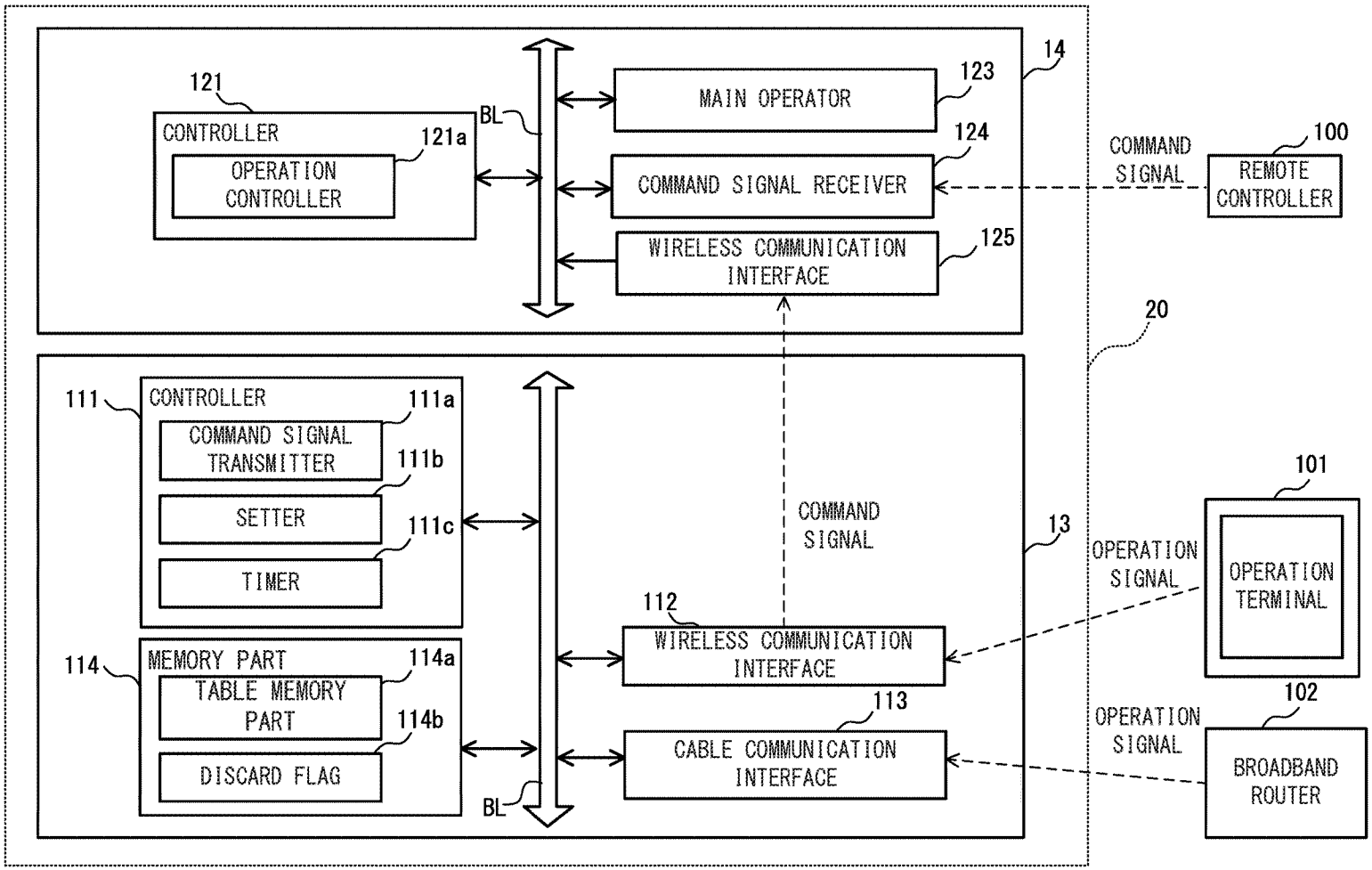
FIG. 6 is a block diagram of a control system according to a second embodiment.

As described above, according to the control system 10 of the first embodiment, the electrical apparatus 12 sets the remote operation prohibition time interval and discards the command signal transmitted from the HEMS controller 11. In contrast, according to a control system 20 of a second embodiment as shown in FIG. 6, a HEMS controller 13 sets a remote operation prohibition time interval and discards an operation signal transmitted from an operation terminal 101. Thus when a user operation is performed using a remote controller 100, during the remote operation prohibition time interval thereafter, even when an operation of an electrical apparatus 14 of the second embodiment is commanded due to user operation of the operation terminal 101, the electrical apparatus 14 does not execute control corresponding to the operation command. Furthermore, the HEMS controller 13 corresponds to the "control device" mentioned in the Claims.

The control system 20 of the second embodiment is explained below in reference to FIGS. 6 and 7. Furthermore, components that are identical to those of the control system 10 of the first embodiment are assigned the same reference sign.

The control system 20 shown in FIG. 6 includes the HEMS controller 13 for transmitting to the electrical apparatus 14 a command signal included in the operation signal transmitted from the operation terminal 101, and also includes the electrical apparatus 14 operating according to the command signal transmitted from the HEMS controller 13 or according to the command signal transmitted from the remote controller 100.

The electrical apparatus 14 is equipped with a controller 121 for overall control of the electrical apparatus 14, a main operator 123 as a constituent part for enabling a fundamental function, such as heat exchange, of the electrical apparatus 14, a command signal receiver 124 for receiving the command signal transmitted from the remote controller 100, a wireless communication interface 125 to make possible wireless communication. That is to say, in the electrical apparatus 14, the memory part 122 of the electrical apparatus 12 of the first embodiment is absent. Each of the components 121 and 123 to 125 are mutually connected via a bus line BL.

The CPU of the controller 121 executes a program, such as a program for executing the below-described operations shown in FIG. 7, stored in ROM so as to enable functioning as an operation controller 121*a* for control of the main operator 123, in the same manner as the controller 121 of the first embodiment. Furthermore, in contrast to the controller 121 of the first embodiment, the CPU of the controller 121 of the present embodiment is not enabled to function as the setter 121*b* and is not equipped with the timer 121*c*.

Upon receiving the command signal from the remote controller 100, the operation controller 121*a* transmits the acceptance signal to the HEMS controller 13. The acceptance signal includes a command signal from the remote controller 100 and a signal indicating reception of the command signal from the remote controller 100.

In the same manner as the HEMS controller 11 of the first embodiment, the HEMS controller 13 is equipped with a controller 111 for overall control of the HEMS controller 13, a wireless communication interface 112 to make possible wireless communication, and a cable communication interface 113 to make possible cable communication. The HEMS controller 13 is further equipped with a memory part 114. The controller 111, the wireless communication interface 112, the cable communication interface 113 and the memory part 114 are mutually interconnected by a bus line BL.

In the same manner as the controller 111 of the first embodiment, the CPU of the controller 111 executes a program, such as the program for executing the below-described operations shown in FIG. 7, stored in ROM, so as to enable functioning as a command signal transmitter 111*a* to receive the operation signal transmitted from the operation terminal 101 and to transmit to the wireless communication interface 112 the command signal included in the received operation signal.

Furthermore, the CPU of the controller 111 executes a program stored in ROM so as to enable functioning as a setter 111*b* for setting a time interval, that is, a remote operation prohibition time interval, for discarding the received operation signal. Moreover, the CPU of the controller 111 is equipped with a timer 111*c* for counting down time remaining until completion of the remote operation prohibition time interval.

When the acceptance signal transmitted from the electrical apparatus 14 is received through the wireless communication interface 112, the setter 111*b* performs the following operations. That is to say, the setter 111*b* retrieves from a prohibition table (see FIG. 3) stored in the memory part 114 a record that matches the contents of the command signal included in the acceptance signal.

Then if a setting condition, such as "room internal temperature at least 28° C.", included in the retrieved record is satisfied, the setter 111*b* determines that the time included in the record is the remote operation prohibition time interval.

Thereafter, the setter 111*b* sets the timer 111*c* to a count value corresponding to the determined remote operation prohibition time interval and causes the timer 111*c* to start the countdown. Moreover, the setter 111*b* turns a below-described discard flag 114*b* ON. If the discard flag 114*b* is ON, even when the operation signal is received using the wireless communication interface 112, the command signal transmitter 111*a* discards the received operation signal, that is to say, transmission of the command signal to the electrical apparatus 14 is prohibited.

Upon completion of the countdown of the timer 111*c*, the setter 111*b* turns the discard flag 114*b* OFF. If the discard flag 114*b* is OFF, when the operation signal is transmitted from the operation terminal 101, the command signal transmitter 111*a* transmits the command signal included in the operation signal to the electrical apparatus 14.

The memory part 114, for example, includes flash memory. The memory part 114 is equipped with a table memory part 114*a*, for storing the prohibition table, and the discard flag 114*b*, that is turned ON upon start of the countdown of the timer 111*c*, and is turned OFF at the end of the countdown of the timer 111*c*.

In the same manner as the prohibition table of the first embodiment, the prohibition table stored in the table memory part 114*a*, as shown in FIG. 3, is a data table of multiple records in which the contents of the command signal, the setting conditions, and the time intervals are associated with each other.

In the above-described manner, the setter 111*b* sets the remote operation prohibition time interval based on the prohibition table. For example, if a command signal indicating start of air conditioning is included in the acceptance signal transmitted from the electrical apparatus 14, the setter 111*b* retrieves from the prohibition table stored in the memory part 114 a record that matches the content indicating the start of air conditioning. According to the prohibition table indicated in FIG. 3, the no. 1 and no. 2 records are retrieved.

Next, because the setting condition included in the retrieved record is a condition related to room internal temperature, the setter 111*b* determines whether the room internal temperature included in the acquired condition data exceeds 28° C. If the room internal temperature exceeds 28° C., the setter 121*b* sets the remote operation prohibition time interval to 60 minutes. On the other hand, if the room internal temperature is less than or equal to 28° C., the setter 121*b* sets the remote operation prohibition time interval to 30 minutes.

In addition, if a command signal indicating change of air conditioning temperature is included in the acceptance signal transmitted from the electrical apparatus 14, and if the range of the temperature change indicated by the command signal is within 2° C., the setter 111*b* sets the remote operation prohibition time interval to 15 minutes.

The setter 111*b* sets the timer 111*c* to a count value corresponding to the set remote operation prohibition time interval and causes the timer 111*c* to start the countdown.

Figure 7:
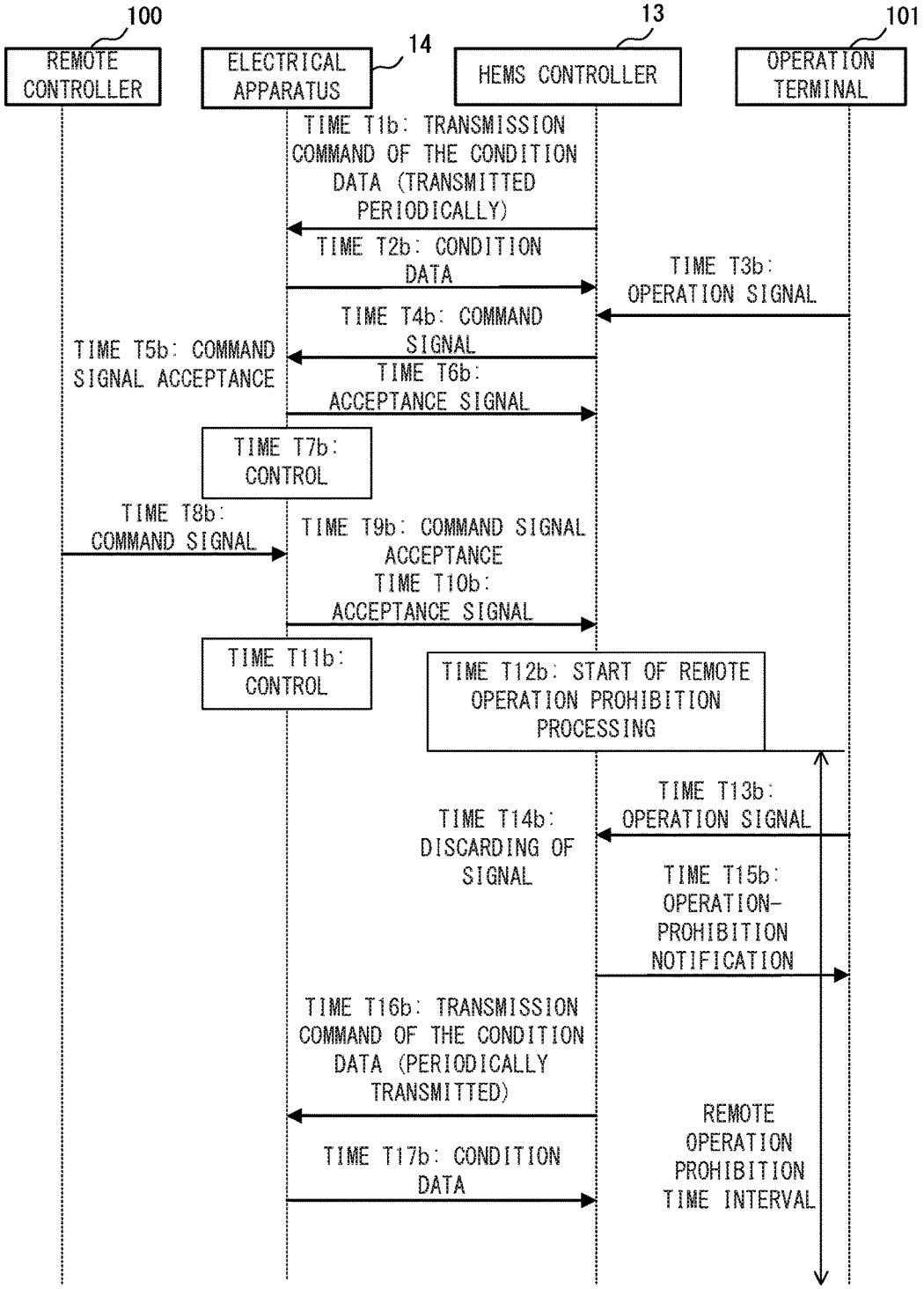
FIG. 7 is a chart showing operation of the control system according to the second embodiment.

Operation when power is turned ON to each of the aforementioned HEMS controller 13, the electrical apparatus 14, the remote controller 100 and the operation terminal 101 is explained in reference to FIG. 7. Furthermore, during the time interval from time T1*b* to T7*b*, operation is the same as that from T1*a* to T7*a* of the control system 10 of the first embodiment, that is to say, operation is the same as the operation explained in reference to FIG. 4. Thus description of operation during times T1*b* to T7*b* is omitted.

After the time T7*b*, when a user operation is performed using the remote controller 100 to transmit the command signal from the remote controller 100 (time T8*b*), and then when the command signal is received by the electrical apparatus 14 (time T9*b*), the electrical apparatus 14 transmits the acceptance signal included in the received command signal to the HEMS controller 13 via the wireless communication interface 125 (time T10*b*). Then the electrical apparatus 14 (operation controller 121*a*) controls the main operator 123 according to the content of the received command signal (time T11*b*).

On the other hand, when the acceptance signal is received from the electrical apparatus 14, the HEMS controller 13 starts remote operation prohibition processing to prohibit remote operation (time T12*b*).

Furthermore, the remote operation prohibition processing executed by the HEMS controller 13 (setter 111*b*) is nearly the same processing as the remote operation prohibition processing of FIG. 5 executed by the electrical apparatus 12 (setter 121*b*) of the first embodiment.

More specifically, the remote operation prohibition processing of the present embodiment differs from the remote operation prohibition processing of the first embodiment in the processing of step S18 of the flowchart shown in FIG. 5. According to the remote operation prohibition processing of the present embodiment, a determination is made in step S18 as to whether a new acceptance signal is being received from the electrical apparatus 14.

Due to the start of remote operation prohibition processing by the HEMS controller 13, the remote operation prohibition time interval is set, and the countdown of the timer 111*c* is started (time T12*b*).

Thereafter, when a user operation is performed using the operation terminal 101, the operation signal is transmitted from the operation terminal 101, and then when the operation signal is received using the HEMS controller 13 (time T13*b*), the HEMS controller 13 (command signal transmitter 111*a*) determines whether the discard flag 114*b* is ON or OFF. The discharge flag 114*b* is ON during the remote operation prohibition time interval. Thus the HEMS controller 13 (command signal transmitter 111*a*) discards the received operation signal (time T14*b*). Then the HEMS controller 13 (command signal transmitter 111*a*) transmits to the operation terminal 101 an operation-prohibition notification indicating that the operation signal was rejected (time T15*b*).

Even during the remote operation prohibition time interval, the HEMS controller 13 periodically transmits to the electrical apparatus 13 a transmission command of condition data (time T16*b*). When the transmission command is received, the electrical apparatus 14 transmits the condition data to the HEMS controller 13 (time T17*b*).

When the remote operation prohibition time interval ends, the HEMS controller 13 (setter 111*b*) turns the discard flag 114*b* OFF. After completion of the remote operation prohibition time interval, when the operation signal is received using the wireless communication interface 112, the HEMS controller 13 (setter 111*b*) transmits the command signal included in the operation signal to the electrical apparatus 14.

As described above, according to the control system 20 of the present embodiment, when the acceptance signal transmitted from the electrical apparatus 14 is received, the HEMS controller 13 sets the remote operation prohibition time interval, and all operation signals received from the operation terminal 101 during the remote operation prohibition time interval are discarded. That is to say, when a user operation is performed using the remote controller 100, even when an operation command for the electrical apparatus 14 is then given by user operation of the operation terminal 101 during the remote operation prohibition time interval, the electrical apparatus 14 does not perform the control corresponding to the operation command. Thus control by remote operation that is unanticipated by the user operating the remote controller 100 immediately beforehand can be prevented, and as a result, comfort and safety of the user can be secured.

Moreover, according to the control system 20 of the present embodiment, the HEMS controller 13 sets the remote operation prohibition time interval based on content and the like of the command signal included in the acceptance signal transmitted from the electrical apparatus 14. By this means, a pleasant remote operation prohibition time interval can be set according to operation content, condition of the room interior R and the like. Thus safe remote control can be attained without causing inconvenience for the user. Furthermore, since configuration for performing remote operation prohibition processing is unnecessary, attainment is readily possible using a versatile electrical apparatus as the electrical apparatus 14.

Third Embodiment

A control system of a third embodiment is explained next. Furthermore, components that are identical to those of the control system 20 of the second embodiment are assigned the same reference sign.

As described above, according to the control system 20 of the second embodiment, when the acceptance signal transmitted from the electrical apparatus 14 is received, based on the content and the like of the command signal included in the acceptance signal, the HEMS controller 13 sets the remote operation prohibition time interval. In contrast, according to the control system of the third embodiment, if there is a change in the control state indicated by the condition data acquired periodically from the electrical apparatus 14, the HEMS controller 13 identifies contents of the command signal ordering the control that causes the change, and sets the remote operation prohibition time interval based on the contents of the identified command signal and the like.

The control system of the third embodiment has the same configuration as that of the control system 20 of the second embodiment. That is to say, the control system of the third embodiment, as shown in FIG. 6, includes the HEMS controller 13 for transmitting to the electrical apparatus 14 a command signal included in the operation signal transmitted from an operation terminal 101, and includes an electrical apparatus 14 operating according to a command signal transmitted from the HEMS controller 13 or according to a command signal transmitted from a remote controller 100.

When condition data is received from the electrical apparatus 14, a setter 111*b* in the control system of the third embodiment stores, for example, in RAM the condition data, which is, for example, data indicating air conditioning setting temperature, operating condition, room internal temperature, content of an accepted command signal, source of transmission of a command signal and the like. Then the setter 111*b* determines whether there is a change in the control state by reading from RAM latest condition data (that is, present-timing received condition data) and condition data received one timing earlier (that is, previous-timing received condition data), and then comparing the condition data.

For example, if some change occurs in the operating condition and the air conditioning setting temperature, the setter 111*b* determines that there is a change in the control state. When there is a determination that there is a change in the control state, from the condition data received previously, the setter 111*b* determines whether the command signal received immediately before the generation of the change (that is, the command signal previously ordering control causing the change) is a signal previously transmitted from the remote controller 100.

When the determination is made that the command signal ordering control causing the change is a signal transmitted from the remote controller 100, the setter 111*b* retrieves a record matching the content of the command signal from a prohibition table stored by the memory part 114. Then when a setting condition (for example, whether room interior temperature is at least 28° C. and the like) included in the retrieved record is satisfied, the setter 111*b* determines that the time included in the record is the remote operation prohibition time interval. The setter 111*b* sets the timer 111*c* to a count value corresponding to the determined remote operation prohibition time interval and causes the timer 111*c* to start counting down. Moreover, the setter 111*b* turns the discard flag 114*b* ON. If the discharge flag 114*b* is ON, even upon reception of the operation signal transmitted from the operation terminal 101, the command signal transmitter 111*a* discards the received operation signal, which means that remote operation is prohibited.

When the countdown of the timer 111*c* ends, the setter 111*b* turns the discard flag 114*b* OFF. If the discard flag 114*b* is OFF, when the operation signal transmitted from the operation terminal 101 is received, the command signal transmitter 111*a* transmits to the electrical apparatus 14 the command signal included in the operation signal.

Figure 8:
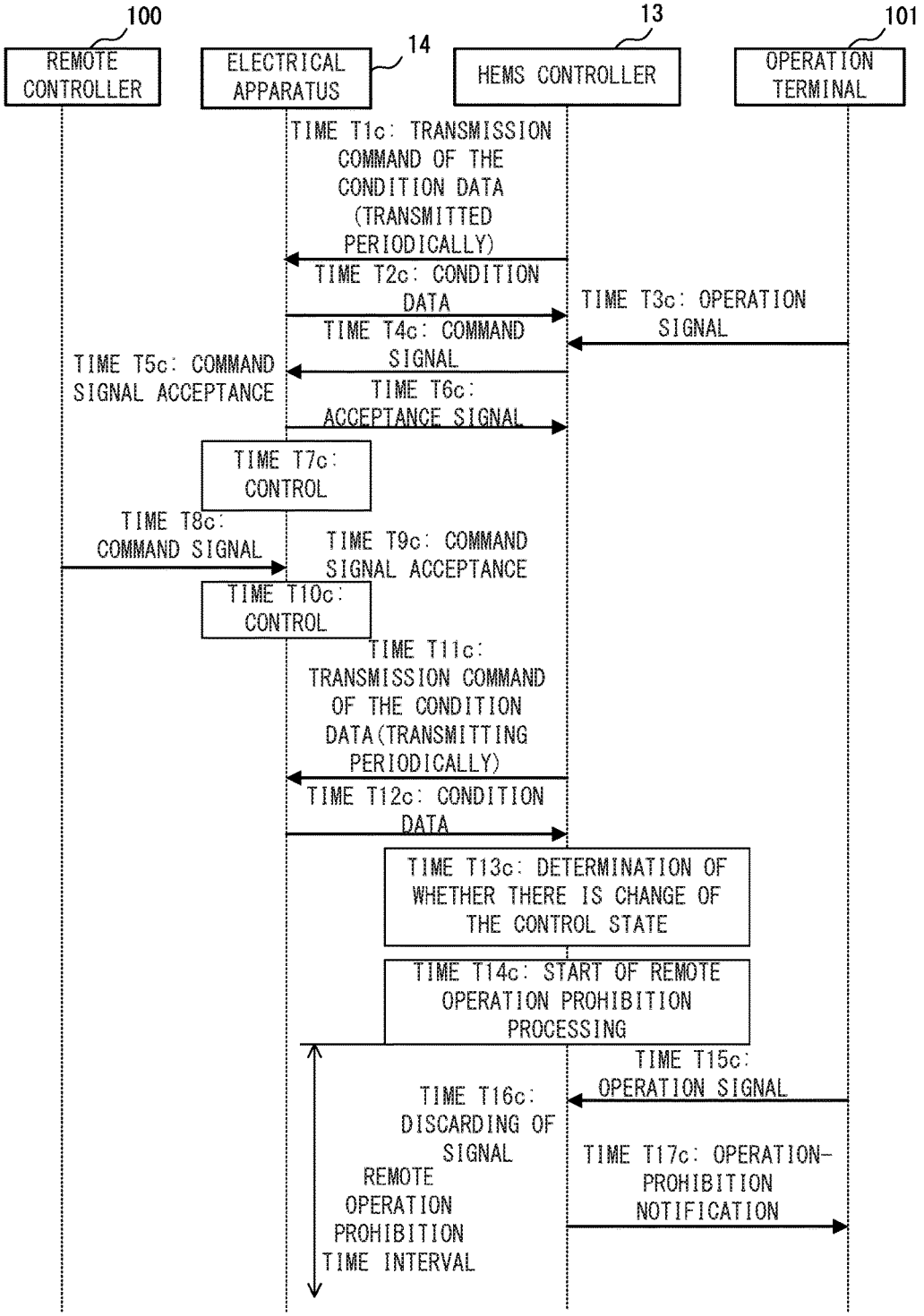
FIG. 8 is a diagram showing operation of a control system according to a third embodiment.

Operation when power is turned ON to each of the aforementioned HEMS controller 13, the electrical apparatus 14, the remote controller 100 and the operation terminal 101 is explained in reference to FIG. 8. Furthermore, during the time interval from time T1*c* to T7*c*, operation is the same as that from time T1*b* to T7*b* of the control system 20 of the second embodiment, that is to say, operation is the same as the operation explained in reference to FIG. 7. Thus explanation of the operations in the time interval T1*c* to T7*c* is omitted.

After the time T7*c*, when a user operation is performed using the remote controller 100 to transmit the command signal from the remote controller 100 (time T8*c*), and then when the command signal is received by the electrical apparatus 14 (time T9*c*), the electrical apparatus 12 (operation controller 121*a*) controls the main operator 123 according to contents of the received command signal (time T10*c*).

Thereafter, the HEMS controller 13 transmits the transmission command of the condition data to the electrical apparatus 14 (time T11*c*). When the transmission command is received, the electrical apparatus 14 transmits the condition data to the HEMS controller 13 (time T12*c*).

When the control data is received, the HEMS controller 13, for example, stores the control data in RAM. The HEMS controller 13 (setter 111*b*) determines whether there is a change in the control state by reading from RAM latest condition data (that is, present-timing received condition data) and condition data received one timing earlier (that is, previous-timing received condition data), and then comparing the condition data (time T13*c*). When the determination is that the control state is previously changed, the HEMS controller 13 (setter 111*b*) determines, based on the condition data received during the previous timing, whether the command signal received immediately before the generation of the change is a signal transmitted from the remote controller 100 (time T13*c*).

Furthermore, each time that the condition data is acquired, the HEMS controller 13 (setter 111*b*) executes the aforementioned processing that occurs at the time T13*c*.

In the processing that occurs at the time T13*c*, when the HEMS controller 13 (setter 111*b*) determines that the command signal commanding the control causing the change is the signal transmitted from the remote controller 100, remote operation prohibition processing to prohibit remote operation starts (time T14*c*).

Furthermore, the remote operation prohibition processing executed by the HEMS controller 13 (setter 111*b*) is nearly the same processing as the remote operation prohibition processing of FIG. 5 executed by the electrical apparatus 12 (setter 121*b*) of the first embodiment.

More specifically, the remote operation prohibition processing of the present embodiment differs from the remote operation prohibition processing of the first embodiment in the processing of steps S11 and S18 of the flowchart shown in FIG. 5. According to the remote operation prohibition processing of the present embodiment, in step S11, a record matching the contents of the command signal commanding the control previously causing the change is retrieved from the prohibition table. Moreover, according to the remote operation prohibition processing of the present embodiment, in step S18, determination is made as to whether there is a change of control state caused by the command signal transmitted from the remote controller 100.

Due to execution of the remote operation prohibition processing by the HEMS controller 13 (setter 111*b*), the remote operation prohibition time interval is set, and the countdown of the timer 111*c* is started (time T14*c*).

Thereafter, when a user operation is performed using the operation terminal 101 so that the operation signal is transmitted from the operation terminal 101 (time T15*c*), the HEMS controller 13 (command signal transmitter 111*a*) determines whether the discard flag 114*b* is ON or OFF. The discard flag 114*b* is ON during the remote operation prohibition time interval. Thus the HEMS controller 13 (command signal transmitter 111*a*) discards the received operation signal (time T16*c*). Then the HEMS controller 13 (command signal transmitter 111*a*) transmits to the operation terminal 101 an operation-prohibition notification indicating that the operating signal was rejected (time T17*c*).

When the remote operation prohibition time interval ends, the HEMS controller 13 (setter 111*b*) turns the discard flag 114*b* OFF. After completion of the remote operation prohibition time interval, when the operation signal is received from the operation terminal 101, the HEMS controller 13 (setter 111*b*) transmits to the electrical apparatus 14 the command signal included in the operation signal.

As described above, according to the control system of the present embodiment, when the command signal transmitted from the electrical apparatus 14 is received, the HEMS controller 13 sets the remote operation prohibition time interval, and all operation signals received from the operation terminal 101 during the remote operation prohibition time interval are discarded. That is to say, when a user operation is performed using the remote controller 100, even when a user operation is performed using the operation terminal 101 during the remote operation prohibition time interval, the electrical apparatus 14 does not execute the control corresponding to the operation command. Thus control by remote operation that is unanticipated by the user operating the remote controller 100 immediately beforehand can be prevented, and as a result, comfort and safety of the user can be secured.

Moreover, according to the control system of the present embodiment, the HEMS controller 13 sets the remote operation prohibition time interval based on content and the like of the command signal (command signal from the remote controller 100) commanding control previously causing the change. Thus the remote operation prohibition time interval can be set that is suitable according to operation content, state of the room interior R and the like. Thus safe remote control can be attained without causing inconvenience for the user. Furthermore, since special processing is unnecessary, attainment is readily possible using a versatile electrical apparatus as the electrical apparatus 14.

Moreover, according to the control system of the present embodiment, from the periodically received condition data, the HEMS controller 13 identifies the contents of the command signal, from the remote controller 100, that commanded the control causing the change. Then the HEMS controller 13 sets the remote operation prohibition time interval based on the contents and the like of the identified command signal. Thus the electrical apparatus 14 of the present embodiment does not require special configuration other than configuration for transmission of the condition data. Therefore, the control system of the present embodiment is highly versatile in comparison to a system that requires an electrical apparatus equipped with a specialized configuration in addition to a configuration for transmission of the condition data.

Fourth Embodiment

Figure 9:
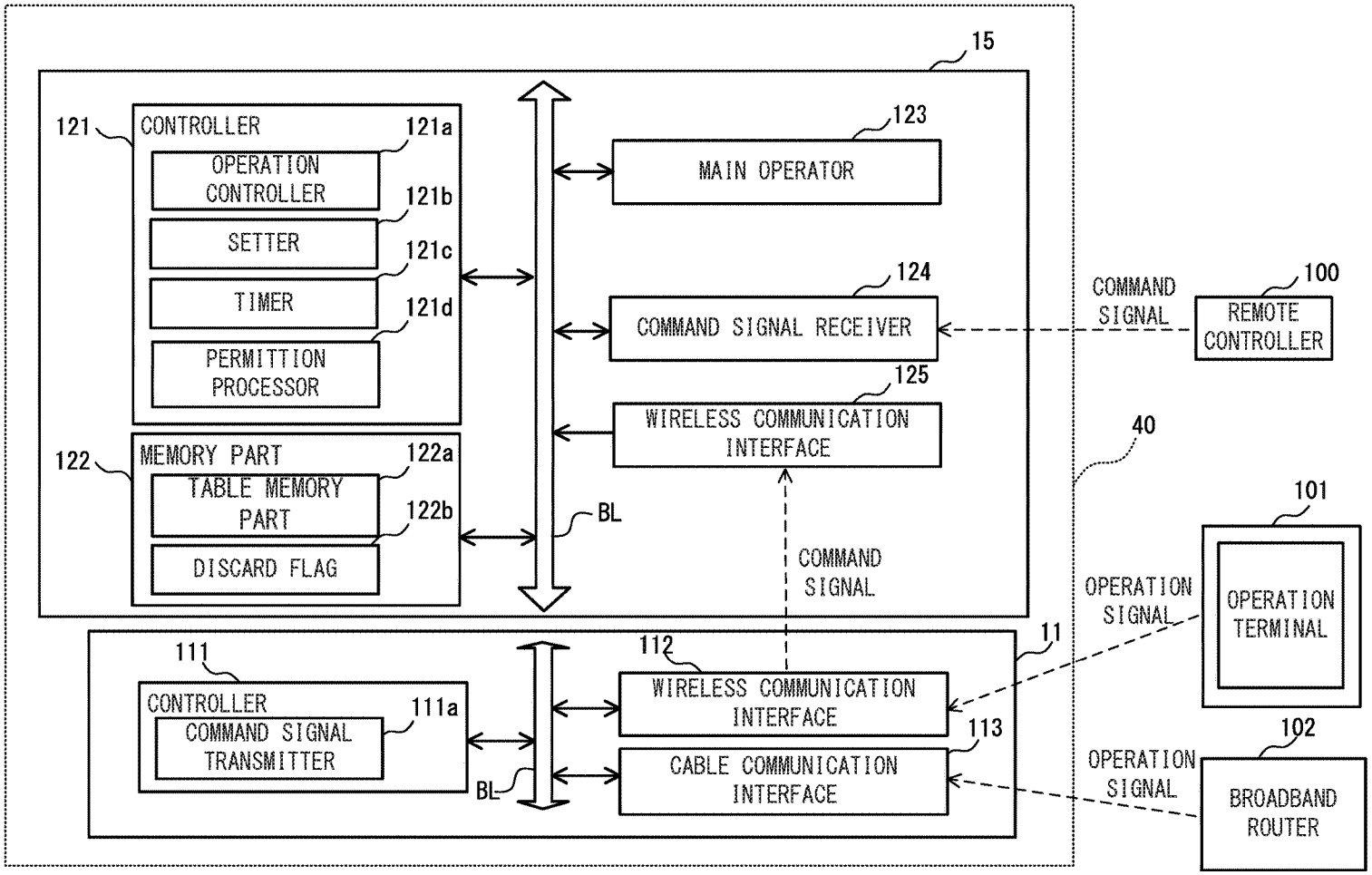
FIG. 9 is a block diagram of a control system according to a fourth embodiment.
Figure 10:
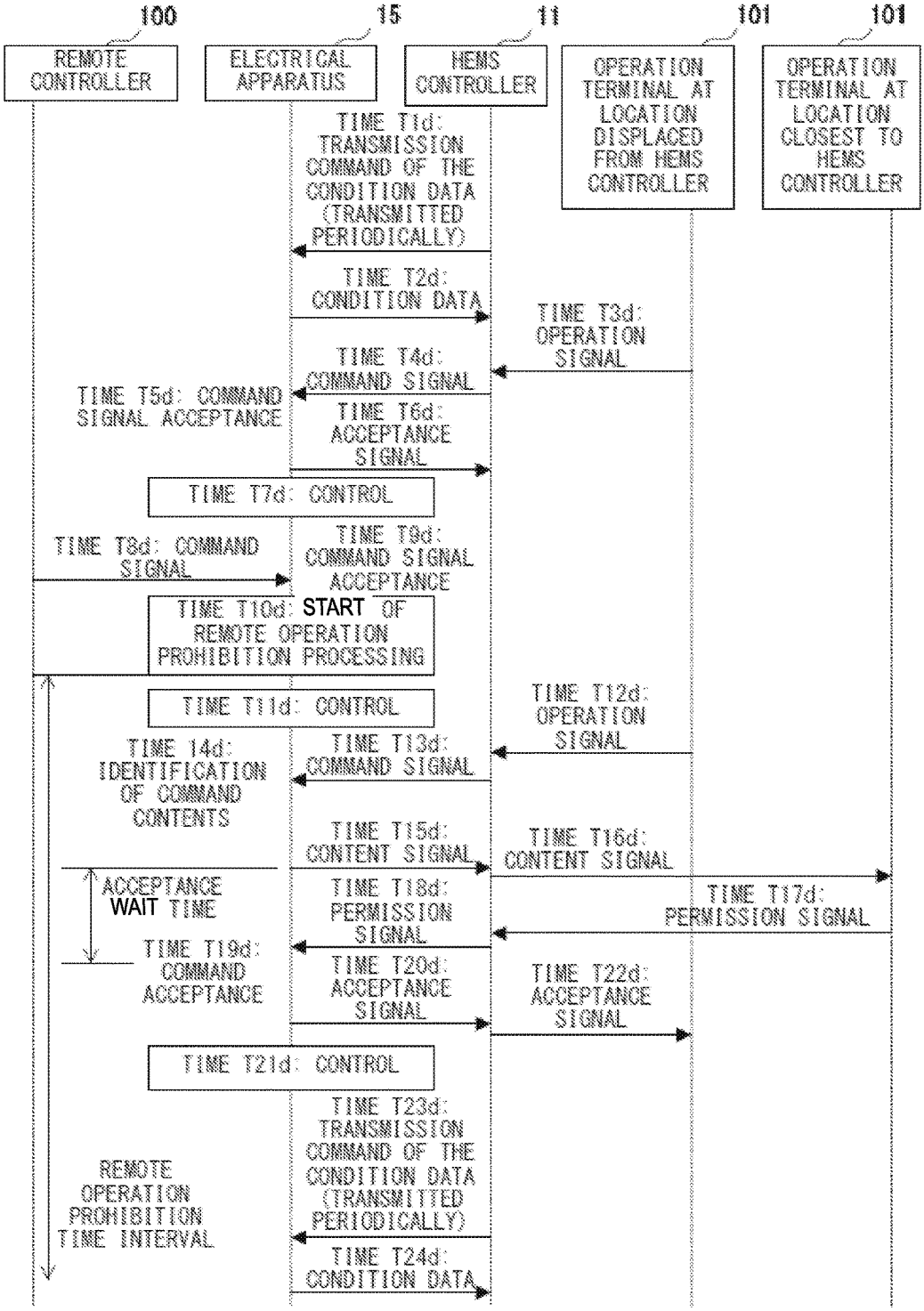
FIG. 10 is a diagram showing operation of the control system according to the fourth embodiment.

In the above-described manner, according to the control system 10 of the first embodiment, the electrical apparatus 12 discards the command signal transmitted from the HEMS controller 11 during the remote operation prohibition time interval. In contrast, according to a control system 40 of a fourth embodiment as shown in FIGS. 9 and 10, even during the remote operation prohibition time interval, if permission of a user located in the vicinity of the HEMS controller 11 is obtained, the electrical apparatus 15 performs an operation based on contents of a command signal transmitted from the HEMS controller 11.

That is to say, according to the control system 40 of the fourth embodiment, during the remote operation prohibition time interval, when the command signal transmitted from the HEMS controller 11 is received, the electrical apparatus 15 identifies contents of the command signal and transmits to the HEMS controller 11 the content signal indicating contents of the command signal. Thereafter, the HEMS controller 11 transmits the received content signal to an operation terminal 101, that is, to the operation terminal 101 displaying a maximum signal strength, that is nearest to the HEMS controller 11.

If a permission signal indicating permission to control contents indicated by the content signal cannot be received within a pre-determined signal reception wait time interval from the operation terminal 101 located nearest to the HEMS controller 11, the electrical apparatus 15 discards the command signal transmitted from the HEMS controller 11.

Furthermore, if the permission signal is received within the previously determined signal reception wait time interval from the operation terminal 101 located nearest to the HEMS controller 11, the electrical apparatus 15 controls the main operator 123 based on the command signal transmitted from the HEMS controller 11.

In this manner, according to the control system 40 of the fourth embodiment, even during the remote operation prohibition time interval, when a permission signal is received within the signal reception wait time interval from the operation terminal 101 located nearest to the HEMS controller 11 (operation terminal 101 displaying the maximum signal strength), the electrical apparatus 15 performs control based on remote operation. Such a configuration is used because the user operating the operation terminal 101 located nearest to the HEMS controller 11 is considered to generally understand the state (room temperature and the like) of the room interior R in which the electrical apparatus 15 is arranged, and to be able to appropriately determine appropriateness of the remote operation.

The control system 40 of the fourth embodiment is explained below in reference to FIGS. 9 and 10. Furthermore, components that are identical to those of the control system 10 of the first embodiment are assigned the same reference sign.

The control system 40 shown in FIG. 9 includes an HEMS controller 11 for transmitting to the electrical apparatus 15 a command signal included in an operation signal transmitted from the operation terminal 101, and includes the electrical apparatus 15 that operates according to the command signal transmitted from the HEMS controller 11 or the command signal transmitted from the remote controller 100.

The HEMS controller 11 has a configuration identical to the configuration used in the control system 10 of the first embodiment.

The electrical apparatus 15, in the same manner as the electrical apparatus 12 of the first embodiment, is equipped with a controller 121 for overall control of the electrical apparatus 15, a memory part 122 for storage of information accessed by the controller 121, a main operator 123 as a constituent part for enabling fundamental functions of the electrical apparatus 15 such as a heat exchange function and the like, a command signal receiver 124 for receiving the command signal transmitted from the remote controller 100, and the wireless communication interface 125 for enabling wireless communication. Each of the components 121 to 125 is interconnected using a bus line BL.

By execution of a program stored in ROM (for example, by execution of a program for realizing the below-described operations shown in FIG. 10), the CPU of the controller 121, in the same manner as the controller 121 of the first embodiment, enables functioning as an operation controller 121*a* for control of the main operator 123 and a setter 121*b* for setting a time interval, that is, a remote operation prohibition time interval, for discarding the received command signal. Moreover, the CPU of the controller 121 is equipped with a timer 121*c* for counting time of the remaining time interval until completion of the remote operation prohibition time interval.

Furthermore, by execution of the program stored in ROM and by obtaining permission of the user present in the vicinity of the HEMS controller 11, the CPU of the controller 121 enables functioning as a permission processor 121*d* that, as an exception even during the remote operation prohibition time interval, accepts the command signal transmitted from the HEMS controller 11.

When the command signal from the HEMS controller 11 is received during the remote operation prohibition time interval, the permission processor 121*d* identifies contents of the command signal. Then the permission processor 121*d* transmits to the HEMS controller 11 a content signal indicating the contents of the command signal. The HEMS controller 11 having received the content signal transmits the content signal to the operation terminal 101 displaying the maximum signal strength, that is, to the operation terminal 101 that is most closely located, using wireless communication, such as Wi-Fi communication through a wireless communication interface 112.

The operation terminal 101, having received the content signal, displays on a display the contents of the content signal and prompts the user to make a selection as to whether to allow the control indicated by the contents of the content signal. When an operation is performed to allow the control indicated by the contents of the content signal, the operation terminal 101 transmits a permission signal to the HEMS controller 11. Furthermore, if an operation is performed to not allow the control indicated by the contents of the content signal, the operation terminal 101 does not transmit the permission signal to the HEMS controller 11.

When the permission signal is received within the predetermined signal reception wait time interval after transmission of the content signal, the permission processor 121*d* accepts the command signal transmitted from the HEMS controller 11. When the command signal is accepted by the permission processor 121*d*, the operation controller 121*a* controls the main operator 123 according to the contents of the command signal.

On the other hand, when the permission signal is not received within the predetermined signal reception wait time interval, the permission processor 121*d* discards the command signal transmitted from the HEMS controller 11. The permission processor 121*d* uses the timer 121*c* to perform the countdown of the signal reception wait time interval.

Operation when power is turned ON to each of the aforementioned HEMS controller 11, the electrical apparatus 15, the remote controller 100, an operation terminal 101 displaced from the HEMS controller 11, and the operation terminal 101 located most closely to the HEMS controller 11 is explained in reference to FIG. 10. Furthermore, during the time interval from time T1*d* to T11*d*, operation is the same as that from time T1*a* to T11*a* of the control system 10 of the first embodiment, that is to say, operation is the same as the operation explained in reference to FIG. 4. Thus explanation of operation during times T1*d* to T11*d* is omitted.

When the operation signal is received from the operation terminal 101 displaced from the HEMS controller 11 during the remote operation prohibition time interval (time T12*d*), the HEMS controller 11 transmits to the electrical apparatus 15 the command signal included in the received operation signal (time T13*d*).

When the command signal is received, the electrical apparatus 15 (permission processor 121*d*) identifies the contents of the command signal (time T14*d*). Then the electrical apparatus 15 (permission processor 121*d*) transmits to the HEMS controller 11 the content signal indicating the contents of the command signal (time T15*d*).

Thereafter, the HEMS controller 11 receives the content signal, and by wireless communication such as Wi-Fi communication through the wireless communication interface 112, transmits the content signal to the operation terminal 101 displaying the maximum signal strength (time T16*d*), that is, transmits to the most closely located operation terminal 101.

The operation terminal 101 previously receiving the content signal, then displays the contents of the content signal on the display and prompts the user to make the selection of whether to permit the control indicated by the contents of the content signal. When the operation is performed to permit the control indicated by the contents of the content signal, the operation terminal 101 transmits the permission signal to the HEMS controller 11 (time T17*d*). Furthermore, if an operation is performed that does not permit the control indicated by the contents of the content signal, the operation terminal 101 does not transmit the permission signal to the HEMS controller 11.

The HEMS controller 11 receiving the permission signal transmits to the electrical apparatus 15 the permission signal (time T18*d*).

When the permission signal is received within the signal reception wait time interval (time T18*d*), the electrical apparatus 15 (permission processor 121*d*), as an exception, accepts the command signal received at the time T13*d* (time T19*d*). On the other hand, if the permission signal cannot be received within the signal reception wait time interval, the electrical apparatus 15 (permission processor 121*d*) discards the command signal received at the time T13*d*.

When the command signal received at the time T13*d* is accepted (time T19*d*), the electrical apparatus 15 (operation controller 121*a*) transmits to the HEMS controller 11 an acceptance signal that indicates acceptance of the command signal (time T20*d*). Moreover, the electrical apparatus 15 (operation controller 121*a*), as an exception, controls the main operator 123 according to the contents of the received command signal (time T21*d*).

When the acceptance signal is received, the HEMS controller 11 transmits the acceptance signal to the operation terminal 101 having transmitted the operation signal (time T22*d*).

Even during the remote operation prohibition time interval, the HEMS controller 11 periodically transmits a transmission command of condition data to the electrical apparatus 15 (time T23*d*). Thus even during the remote operation prohibition time interval, when the transmission command is received, the electrical apparatus 15 transmits the condition data to the HEMS controller 13 (time T24*d*).

As described above, according to the control system 40 of the present embodiment, when the command signal transmitted from the HEMS controller 11 is received during the remote operation prohibition time interval, the electrical apparatus 15 identifies the contents of the command signal and transmits to the HEMS controller 11 the content signal indicating the contents of the command signal. Then the HEMS controller 11 transmits the received content signal to the operation terminal 101 located closest to the HEMS controller 11, that is, the operation terminal 101 displaying the maximum signal strength.

When the permission signal indicating that there is permission to control the contents indicated by the content signal is not received, through the HEMS controller 11, in the signal reception wait time interval from the operation terminal 101 transmitting the content signal, the electrical apparatus 15 discards the command signal transmitted from the HEMS controller 11.

On the other hand, when the permission signal is received, through the HEMS controller 11, in the signal reception wait time interval from the operation terminal 101 transmitting the content signal, the electrical apparatus 15 controls the main operator 123 based on the command signal transmitted from the HEMS controller 11.

That is to say, within the signal reception wait time interval, if the permission signal is not received from the operation terminal 101 operated by the user located nearest to the HEMS controller 11 and capable of understanding conditions (for example, conditions of a room interior R) near where the electrical apparatus 15 is arranged, the electrical apparatus 15 discards the command signal transmitted from the HEMS controller 11. Thus the execution of control unanticipated by the user operating the remote controller 100 by remote operation immediately beforehand can be prevented, and as a result, safety and comfort of the user can be secured.

Moreover, according to the control system 40 of the present embodiment, the electrical apparatus 15 is able to set the remote operation prohibition time interval that is suitable according to operation contents, room interior R condition and the like, by setting the remote operation prohibition time interval based on contents of the command signal and the like transmitted from the remote controller 100. Thus remote control can be performed while maintaining safety and without inconveniencing the user.

Although embodiments of the present disclosure are explained above, the present disclosure is not limited to the aforementioned embodiments, and various types of modifications and applications are possible.

During the remote operation prohibition time interval, the aforementioned electrical apparatus 12 of the first embodiment discards the command signal transmitted from the HEMS controller 11. Moreover, during the remote operation prohibition time interval, the HEMS controller 13 of the second and third embodiments discards the operation signal transmitted from the operation terminal 101. However, these configurations are not limiting, and during the remote operation prohibition time interval, if previously determined exception conditions are satisfied, as an exception, the electrical apparatus 12 of the first embodiment may control the main operator 123 based on the command signal transmitted from the HEMS controller 11. Moreover, in the same manner, even during the remote operation prohibition time interval, the HEMS controller 13 of the second and third embodiments, if exception conditions are satisfied, as an exemption, may accept the operation signal transmitted from the operation terminal 101 and may transmit to the electrical apparatus 14 the command signal included in the operation signal transmitted from the operation terminal, so that the electrical apparatus 14 is controlled based on the command signal.

For example, if the content of the command signal is a change of air conditioning temperature, the exception condition may be "change range of setting temperature less than 2° C., and initial operation of the operation terminal 101 during the remote operation prohibition time interval".

Moreover, if the content of the command signal is a stoppage of air conditioning, the exception condition may be "room internal temperature is at least 28° C., and the operation is the initial operation of the operation terminal 101 during the remote operation prohibition time interval".

Operation of the electrical apparatus 12 of the first embodiment using the exception conditions is explained. The exception conditions are recorded in an exception table such as that shown in FIG. 11. During the remote operation prohibition time interval, when the command signal is received, the electrical apparatus 12 identifies contents of the command signal. Then from the exception table the electrical apparatus 12 identifies the exception conditions associated with the contents of the command signal and determines if the condition data and the operation count of the operation terminal 101 (number of transmissions of the operation signal) satisfy the identified exception conditions. If the exception conditions are satisfied, as an exception, the electrical apparatus 12 accepts the command signal and controls the main operator 123 based on the command signal. On the other hand, if the exception conditions are not satisfied, the electrical apparatus 12 discards the command signal.

Operation of the HEMS controller 13 of the second and third embodiments using the exception conditions is explained. During the remote operation prohibition time interval, when the operation signal is received, the HEMS controller 13 of the second and third embodiments identifies the contents of the command signal included in the operation signal. Then from the exception table the HEMS controller 13 identifies the exception conditions associated with the contents of the command signal and determines if the condition data (inclusion of setting temperature) and the operation count of the operation terminal 101 (number of transmissions of the operation signal) satisfy the exception conditions. If the exception conditions are satisfied, as an exception, the HEMS controller 13 transmits to the electrical apparatus 14 the command signal included in the operation signal. The main operator 123 is controlled by this means. On the other hand, if the exception conditions are not satisfied, the HEMS controller 13 discards the operation signal.

In the case of the first embodiment, the exception table is stored by the table memory part 122*a* of the electrical apparatus 12, and in the case of the second and third embodiments, is stored beforehand in the table memory part 114*a* of the HEMS controller 13.

During the remote operation prohibition time interval, the aforementioned HEMS controller 13 of the second and third embodiments discards the operation signal transmitted from the operation terminal 101. However, this configuration is not limiting, and the HEMS controller 13 of the second and third embodiments may perform operations in the same manner as the electrical apparatus 15 of the fourth embodiment.

That is to say, during the remote operation prohibition time interval, when the operation signal is received from the operation terminal 101, the HEMS controller 13 (command signal transmitter 111*a*) of the second and third embodiments identifies the contents of the command signal included in the operation signal. Thereafter, the HEMS controller 13 (command signal transmitter 111*a*) transmits the content signal, indicating the contents of the command signal, to the operation terminal 101 displaying the maximum signal strength (the operation terminal 101 that is most nearly located) using wireless communication (using Wi-Fi communication through the wireless communication interface 112).

The operation terminal 101 that received the content signal displays on the display the contents of the content signal and prompts the user to select whether to permit the control indicated by the contents of the content signal. When an operation is performed that permits the control indicated by the contents of the content signal, the operation terminal 101 transmits the permission signal to the HEMS controller 13. Furthermore, if the operation is performed that prohibits control indicated by the contents of the control signal, the operation terminal 101 does not transmit the permission signal to the HEMS controller 13.

When the permission signal is received within the predetermined signal reception wait time interval after the transmission of the content signal, the HEMS controller 13 (command signal transmitter 111*a*), as an exception, transmits to the electrical apparatus 14 the command signal transmitted from the operation terminal 101. By this means, the electrical apparatus 14, as an exception, controls the main operator 123 according to the contents of the command signal.

On the other hand, if the permission signal could not be received within the signal reception wait time interval, the HEMS controller 13 (command signal transmitter 111*a*) discards the command signal transmitted from the operation terminal 101.

Moreover, when the content signal transmitted from the electrical apparatus 15 is received, the HEMS controller 11 of the fourth embodiment transmits the content signal to the operation terminal 101 displaying the maximum signal strength, although this configuration is not limiting. That is to say, for example, the HEMS controller 11 of the fourth embodiment may transmit the content signal to optionally-multiple operation terminals 101 displaying a signal strength that exceeds a pre-determined threshold value. A configuration may be used in which, if the permission signal is then received from all the operation terminals 101 that have transmitted the content signal, the HEMS controller 11 of the fourth embodiment transmits the permission signal to the electrical apparatus 15.

In the aforementioned embodiments, the program for control of the controllers 111 and 121 may be stored on a computer-readable recording medium such as a flexible disc, compact disc read-only memory (CD-ROM), digital versatile disc (DVD), magneto-optical disc (MO) and the like, and may then be distributed. A configuration may be used in which a program is installed in a computer and the like to form the controllers 111 and 121 for execution of the operations shown in FIGS. 4, 7, 8 and 10, and the processing shown in FIG. 5.

Moreover, the aforementioned program may be stored on a disc device or the like of a certain server device on a communication network such as the internet, and for example, may be superimposed on a carrier wave and then downloaded and the like.

Moreover, in the case of realization of the aforementioned operations indicated in FIGS. 4, 7, 8, and 10 and the processing indicated in FIG. 5 by sharing with each Operating System (OS), by executing by cooperation between the OS and an application, and the like, the non-OS part alone may be stored and distributed on a recording medium, or may be downloaded.

This application claims the benefit of Japanese Patent Application No. 2013-165582, filed on Aug. 8, 2013. The entire specification, claims, and drawings of Japanese Patent Application No. 2013-165582 are incorporated by reference herein.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

INDUSTRIAL APPLICABILITY

The present disclosure can be used with advantage for a system and the like for remote control of an electrical apparatus and the like used in a general household.

REFERENCE SIGNS LIST

10, 20, 40 Control system
11, 13 HEMS controller
12, 14, 15 Electrical apparatus
100 Remote controller
101 Operation terminal
102 Broadband router
103 Internet
111, 121 Controller
114, 122 Memory part
123 Main operator
124 Command signal receiver
112, 125 Wireless communication interface
113 Cable communication interface
BL Bus line

The invention claimed is:

1. A control system, comprising:

an electrical apparatus configured to receive from a remote controller a command signal indicating a control command; and a control device configured to:

receive the command signal from an operation terminal for transmitting, in addition to from a transmission area of the remote controller, from outside the transmission area; and transmit to the electrical apparatus the command signal, wherein the electrical apparatus comprises:

an operation controller configured to control a main operator according to the command signal transmitted from the remote controller and according to the command signal transmitted from the operation terminal; and a setter configured to set a first time interval and a second time interval respectively based on contents of a first commanding signal and contents of a second commanding signal that are transmitted from the remote controller, the second time interval being different from the first time interval, the second commanding signal being different from the first commanding signal, and the operation controller is further configured to:

when the first commanding signal is received from the remote controller, during the first time interval, not control based on the first commanding signal transmitted from the operation terminal; and when the second commanding signal is received from the remote controller, during the second time interval, not control based on the second commanding signal transmitted from the operation terminal.

2. The control system according to claim 1, wherein the operation controller is further configured to, when the command signal transmitted from the operation terminal is received through the control device during a prohibition time interval that includes the first time interval and the second time interval and prohibits operation from the operation terminal, control the main operator according to the command signal when a predetermined exception condition that corresponds to the contents of the received command signal is satisfied.

3. The control system according to claim 1, wherein the electrical apparatus is further configured to, when the command signal transmitted from the operation terminal is received through the control device during the prohibition time interval, transmit to the control device a content signal indicating contents of the received command signal, the control device is further configured to:

communicate wirelessly with the operation terminal;

transmit to the operation terminal the content signal transmitted from the electrical apparatus, the operation terminal displaying maximum signal strength among a plurality of operation terminals; and when a permission signal, indicating that control of the contents indicated by the content signal is permitted, is received from the operation terminal transmitted the content signal, transmit to the electrical apparatus the permission signal, and the operation controller of the electrical apparatus is further configured to, when the permission signal is received, control the main operator based on the command signal.

4. The control system according to claim 1, wherein the operation controller is further configured to, during a prohibition time interval in which operation from the operation terminal is prohibited, not perform control based on the command signal transmitted from the operation terminal, the prohibition time interval being associated with the contents of the command signal and contents of data measured by the electrical apparatus.

5. A control method comprising:

controlling, by an electrical apparatus, a main operator according to a command signal indicating a control command transmitted from a remote controller and according to the command signal transmitted from an operation terminal having a transmission area wider than that of the remote controller; and setting, by the electrical apparatus, a first time interval and a second time interval respectively based on contents of a first commanding signal and contents of a second commanding signal that are transmitted from the remote controller, the second time interval being different from the first time interval, the second commanding signal being different from the first commanding signal, wherein during the controlling by the electrical apparatus:

when the first commanding signal is received from the remote controller, during the first time interval, control based on the command signal transmitted from the operation terminal is not performed, and when the second commanding signal is received from the remote controller, during the second time interval, the control based on the command signal transmitted from the operation terminal is not performed.

6. An electrical apparatus comprising:

a first receiver configured to receive a command signal indicating a control command for the electrical apparatus from a remote controller;

a second receiver configured to receive the command signal indicating the control command for the electrical apparatus from an operation terminal for transmitting, in addition to from within a transmission area of the remote controller, from outside the transmission area; and an operation controller configured to control a main operator according to the command signal received from the first receiver, and according to the command signal received from the second receiver; and a setter configured to set a first time interval and a second time interval respectively based on contents of a first commanding signal and contents of a second commanding signal that are transmitted from the remote controller, the second time interval being different from the first time interval, the second commanding signal being different from the first commanding signal, wherein the operation controller is configured to:

when the first commanding signal is received from the remote controller, during the first time interval, not perform control based on the command signal transmitted from the operation terminal, and when the second commanding signal is received from the remote controller, during the second time interval, not perform control based on the command signal transmitted from the operation terminal.

7. A non-transitory computer-readable recording medium recording a program for enabling a computer to perform:

an operation control function of controlling a main operator according to a command signal that is:

received by a first receiver for receiving the command signal from a remote controller, and received by a second receiver for receiving the command signal from an operation terminal for transmitting the command signal, in addition to from within a transmission area of the remote controller, from outside the transmission area; and a setting function of setting a first time interval and a second time interval respectively based on contents of a first commanding signal and contents of a second commanding signal that are transmitted from the remote controller, the second time interval being different from the first time interval, the second commanding signal being different from the first commanding signal, wherein during the operation control function:

when the first commanding signal is received from the remote controller, during the first time interval, control based on the command signal transmitted from the operation terminal is not performed, and when the second commanding signal is received from the remote controller, during the second time interval, control based on the command signal transmitted from the operation terminal is not performed.

8. A control system according to claim 1, further comprising:

a condition data transmitter configured to, when a transmission command requesting transmission of condition data indicating a condition of the electrical apparatus is received from the operation terminal, transmit the condition data to the operation terminal, wherein the condition data transmitter transmits the condition data to the operation terminal even upon receiving the transmission command from the operation terminal during a prohibition time interval for prohibition of operation from the operation terminal, the prohibition time interval including the first time interval and the second time interval.

9. The electrical apparatus according to claim 6, further comprising:

a condition data transmitter configured to receive, from the operation terminal, a transmission command requesting transmission of condition data indicating condition of the electrical apparatus, and to transmit the condition data to the operation terminal, wherein the condition data transmitter transmits the condition data to the operation terminal even upon receiving the transmission command from the operation terminal during a prohibition time interval for prohibition of operation from the operation terminal, the prohibition time interval including the first time interval and the second time interval.

10. The non-transitory computer-readable recording medium according to claim 7, wherein the program enables the computer to further perform:

a condition data transmission function of receiving from the operation terminal a transmission command requesting transmission of condition data indicating a condition of the computer, and transmitting the condition data to the operation terminal, wherein the condition data transmission function transmits the condition data to the operation terminal even when the transmission command is received from the operation terminal during the first time interval or the second time interval.

* * * * *